US005737874A

United States Patent [19]

Sipos et al.

[11] Patent Number: 5,737,874

[45] Date of Patent: Apr. 14, 1998

[54] SHUTTER CONSTRUCTION AND METHOD OF ASSEMBLY

[75] Inventors: Jeffrey J. Sipos, Reddington Shores; Anthony R. Vross, Odessa, both of Fla.

[73] Assignee: Simon Roofing and Sheet Metal Corp., Boardman, Ohio

[21] Appl. No.: 356,152

[22] Filed: Dec. 15, 1994

[51] Int. Cl.[6] ..... E06B 7/00

[52] U.S. Cl. ..... 49/67; 49/63; 52/202

[58] Field of Search ..... 49/63, 64, 67, 49/61; 52/202, 203, 75, 76, 78, 473, 476, 204.597, 204.591, 204.62, 204.7; 454/221, 224, 278

[56] References Cited

U.S. PATENT DOCUMENTS

| | | | |
|---|---|---|---|
| 752,348 | 2/1904 | Lutts . | |
| 1,659,786 | 2/1928 | Sammet | 454/224 X |
| 2,337,785 | 12/1943 | Thurman | 454/224 X |
| 2,544,500 | 3/1951 | Jacobi | 267/1 |
| 3,055,467 | 9/1962 | Peek et al. | 189/54 |
| 3,120,036 | 2/1964 | Minds | 52/473 X |
| 3,394,518 | 7/1968 | Worrell, Jr. | 52/473 |
| 3,436,885 | 4/1969 | Rothermel | 52/476 X |
| 3,461,629 | 8/1969 | Smith | 52/314 |
| 3,548,555 | 12/1970 | Trostte et al. | 52/473 |
| 3,577,864 | 5/1971 | Sommerfeld | 52/473 |
| 3,949,526 | 4/1976 | Sherlock et al. | 49/501 |
| 4,263,760 | 4/1981 | Gell | 49/63 X |
| 4,454,691 | 6/1984 | Mitchell | 52/202 |
| 4,483,102 | 11/1984 | Edwards | 49/67 X |
| 5,228,238 | 7/1993 | Fenkell | 49/63 |
| 5,306,210 | 4/1994 | Smit | 454/250 |

FOREIGN PATENT DOCUMENTS

| | | | |
|---|---|---|---|
| 52173 | 5/1982 | European Pat. Off. | 49/403 |

*Primary Examiner*—Jerry Redman
*Attorney, Agent, or Firm*—Sand & Sebolt

[57] ABSTRACT

A shutter for withstanding hurricane wind forces has an outer rectangular frame formed by four U-shaped channel members. An inner rectangular frame, also formed of four U-shaped blade channels, is mounted within the U-shaped channels of the outer frame. A plurality of Z-shaped blades extend horizontally between the vertical U-shaped inner blade channels and are secured in an angular position by fasteners. The blades each have a pair of horizontal end flanges which are secured at opposite ends to the inner frame, and have an intervening angled panel of reduced thickness to enable the blades to flex and absorb the wind forces. Longitudinal fins are formed on the inner frame channels and engage portions of the outer frame to radiate wind forces exerted on the blades to the outer frame. A pair of spring-biased plunger rods are mounted at the bottom ends of the outer frame for securing the shutter in a locked position. The shutter is assembled by fastening the blades at their ends to two spaced inner blade channels, sliding the inner frame members within the outer frame members, and then securing the outer frame members together by corner braces to trap the inner frame and blades therein.

26 Claims, 4 Drawing Sheets

FIG-1
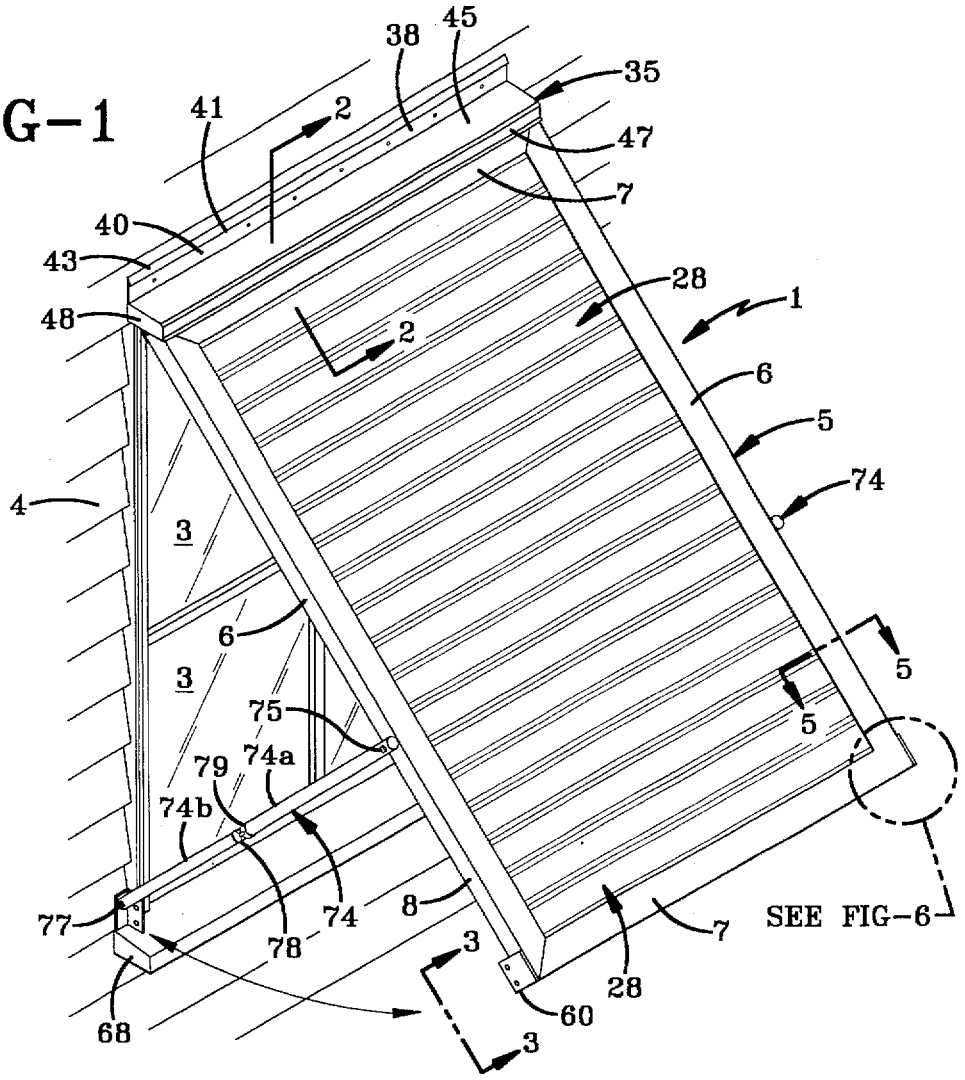
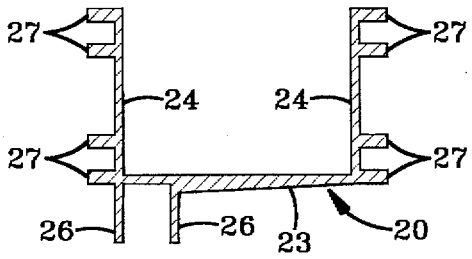
FIG-7
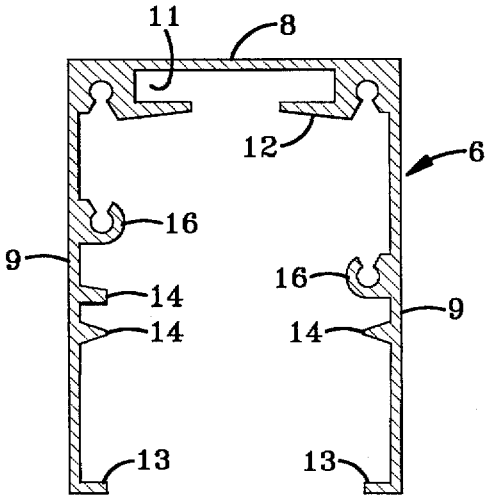
FIG-8

SHUTTER CONSTRUCTION AND METHOD OF ASSEMBLY

BACKGROUND OF THE INVENTION

1. Technical Field

The invention relates to shutters, and particularly to a louvered shutter construction and method of assembly. More particularly, the invention relates to a louvered shutter which is easily assembled and is able to withstand hurricane-strength wind forces and withstand impacts caused by hurricane force winds to protect windows and maintain an intact outer envelope. More particularly, the invention relates to such a shutter construction in which the large wind forces and impacts are absorbed by the various components of the shutter and radiated to the stronger outer frame portion of the shutter.

2. Background Information

Shutters of various configurations, sizes and strength, have been used for years for decorative purposes and for protective purposes. Shutters are still in use today in various portions of the country to provide protection to the window area of a dwelling when experiencing strong wind forces, for example, to protect the window from hurricane-strength wind forces in tropical areas. Although it is always possible to form a shutter of sufficient strength to withstand most hurricane-strength wind forces, it is desirable to form the shutter in as inexpensive and lightweight a manner as possible without sacrificing its ability to withstand such large wind and impact forces. Furthermore, the shutter should be easily assembled and installed on the structure. When a hurricane or other inclement weather threatens, the shutter should be easily lowered into its protective position without use of tools from the inside of the structure. Afterwards, the shutter should be able to be easily returned to its open configuration where its sun-shading ability and decorative function are regained.

Examples of various types of prior art shutter constructions are shown in U.S. Pat. Nos. 752,348, 2,544,500, 3,055,467, 3,461,629, 3,548,555, and 3,394,518. Although these shutter constructions may perform their intended function, they require numerous components which must be specially manufactured and then fabricated into the final structure, and may require welding of the components together to form a sufficiently strong shutter able to withstand hurricane wind forces. Many of these prior shutters require tools to fasten them down when a storm threatens. Also, many of these designs require removal of support arms, or at least removal of their pivot fasteners, for folding. Also, many prior shutter designs also use loose fasteners for attaching the shutter to the wall during storms. All of these disadvantages increase both the cost and weight of the shutter, if made sufficiently strong to withstand hurricane-strength wind forces.

Therefore, the need exists for an improved shutter construction and for a method of assembling such shutter in which a relatively few number of components parts are required, which can be mass produced relatively inexpensively, preferably by extrusion, and then assembled in such a manner by fasteners, such as sheet metal screws, which avoids any welding or similar joining, enabling the shutter to be disassembled and repaired easily, should one or more of the components become damaged.

SUMMARY OF THE INVENTION

Objectives of the invention include providing an improved shutter construction consisting of an inner rectangular frame which is trapped within an outer rectangular frame and is separated therefrom by flexible fins which will radiate the wind forces exerted on the inner frame through the mounted louver blades to the stronger outer frames.

Another objective is to provide such a shutter construction in which the transfer of impact forces travels through the fasteners of the shutters and are dispensed into the outer frame, and then dissipated into the supporting structure. A mechanical redundancy is also provided in the form of interlocking blades and frame hinge extrusions, along with sacrificial inner fins which allow for relatively light extrusions and fasteners.

Another objective is to provide such a shutter construction in which severe impacts which cause fastener failure and extrusion distortion will be controlled by the inner locking design of the extrusions.

Another objective is to provide such a shutter construction in which the shutter is permanently installed on the structure and lowered easily into its closed position when the weather threatens, and then easily opened after the storm has passed.

A still further objective of the invention is to provide such a shutter construction which may be installed in the colonial fashion on both sides of the window, or above the window, which will provide shade to the window when in a raised open position.

Still another objective of the invention is to provide such a shutter construction in which the inner blade channels are slidably mounted within the outer frame channels and then assembled together by corner braces and fasteners which allows unrestrained movement of the extruded frame components due to thermal expansion which is inherent in metallic products such as aluminum, thereby eliminating stress-induced warping, misalignment and fastener failure.

A further objective of the invention is to provide such a shutter construction in which the louver blades have a unique Z-shaped cross-sectional configuration, with end flanges approximately twice the thickness of the connecting flat panel, thereby enabling the panels to flex upon wind forces being exerted thereon, transferring the force to the more rigid end flanges, which, in turn, are secured by fasteners within inner blade channels. The thickened outer flanges of the blades are designed to flex upon impact in such a way as to interlock when distorted beyond approximately one inch. This interlock mechanism is independent of fasteners and provides mechanical redundancy. This interlocking feature shares the force of one blade with many blades, effectively dispersing the load to all components and avoiding failure of any one component of the shutter.

Another objective of the invention is to provide such a shutter construction which has a hinge assembly formed by two uniquely configured extruded components for hingedly mounting the shutter adjacent a window opening. This hinge assembly allows for a 41° shutter open angle, which corresponds closely to the 39° blade inclination, which results in a relatively unobstructed view from the inside of the structure to the outside. Furthermore, vision into the louvered window is hindered by the angle of incidence, and when in a closed position, provides privacy and security to the structure's occupants. Furthermore, the angle of mounting when open, along with the blade angle, provides shading of the glazing, considerably reducing heat gain. This shading eliminates the need for window films and the like used for low heat reduction.

A further objective of the invention is to provide such a shutter construction in which all components of the hinge assembly, as well as all other components, are permanently mounted on the structure adjacent the top of a window to be protected by the shutter, and which has a caulk shelf at an upper edge thereof to receive a bead of caulk to control water flow, and in which nibs formed on the back of the hinge assembly which mounts against the structure, serves to level the supporting surface and control caulk displacement; and in which a second component of the hinge assembly is slidably mounted in the first component for ease of mounting the shutter on the permanently attached hinge component when required by weather conditions.

Another objective of the invention is to provide such a shutter construction using corner braces for joining the outer frame members, which braces enable load to transfer around the corners of the frame, and enables snap-together assembly of the frame channels. Furthermore, the corner braces are held in place by friction fit, and two thread-cutting grooves, which also hold portions of the hinge assembly in order to allow transfer of forces into the structure through the strongest sections of the shutter.

Still another objective of the invention is to provide such a shutter construction in which the shutter support arms are secured to the shutter and are collapsible into a compact position when the shutter is in a closed, locked position on a structure. Furthermore, the shutter arms are captive upon closing the shutter, and require no removal of any fasteners, nor is any assembly required when opening or closing the shutter, in order to reduce the closing time and the possibility of lost parts. Furthermore, the captive components of the shutter cannot become airborne missiles in high winds, and the closing of the shutters is accomplished from within the structure, thereby allowing their ease of use on upper floors.

These and other objectives of the invention are obtained by the improved shutter construction, the general nature of which may be stated as including an outer rectangular frame defined by horizontal and vertical frame channels; an inner rectangular frame defined by horizontal and vertical blade channels, said inner frame being mounted and contained within the outer frame; and a plurality of blades mounted within the inner frame and extending horizontally between the vertical blade channels, said blades being generally Z-shaped in cross section having a pair of end flanges and a panel extending angularly therebetween, said panel being thinner than said end flanges, whereby said panels will flex upon impact forces being exerted thereon transferring said forces to the thicker end flanges.

BRIEF DESCRIPTION OF THE DRAWINGS

A preferred embodiment of the invention, illustrative of the best mode in which applicants have contemplated applying the principle, is set forth in the following description and is shown in the drawings and is particularly and distinctly pointed out and set forth in the appended claims.

FIG. 1 is a diagrammatic perspective view of the improved shutter construction of the invention mounted on a structure and shown in an open position;

FIG. 7 is a cross-sectional view of one of the blade channels;

FIG. 8 is a cross-sectional view of one of the frame channels;

Similar numerals refer to similar parts throughout the drawings.

DESCRIPTION OF THE PREFERRED EMBODIMENT

The improved shutter construction of the present invention is indicated generally at 1, and is shown in FIG. 1 in an open position with respect to a window 3 formed in a supporting structure 4.

Figure 2:
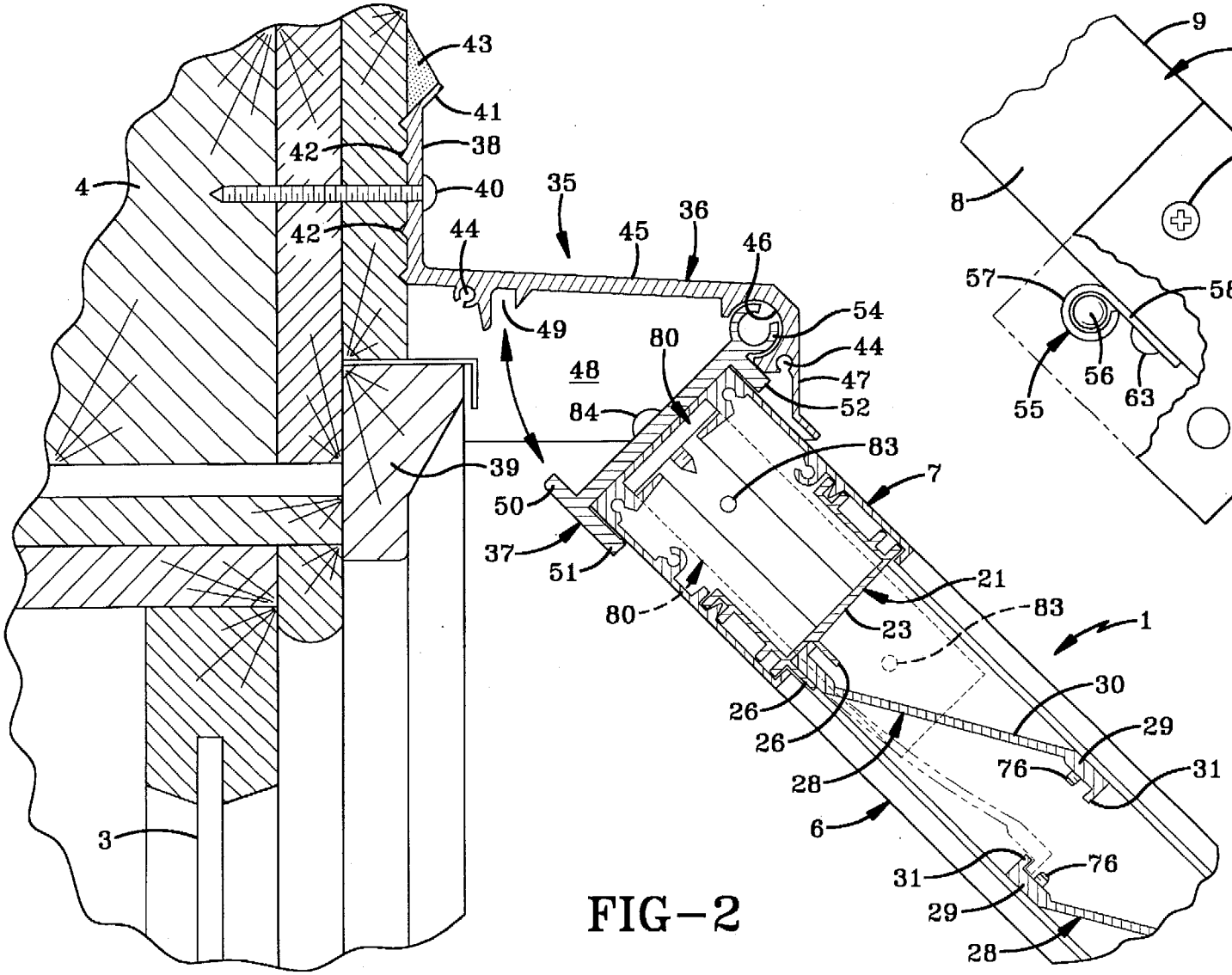
FIG. 2 is an enlarged fragmentary sectional view taken on line 2—2, FIG. 1.
Figure 5:
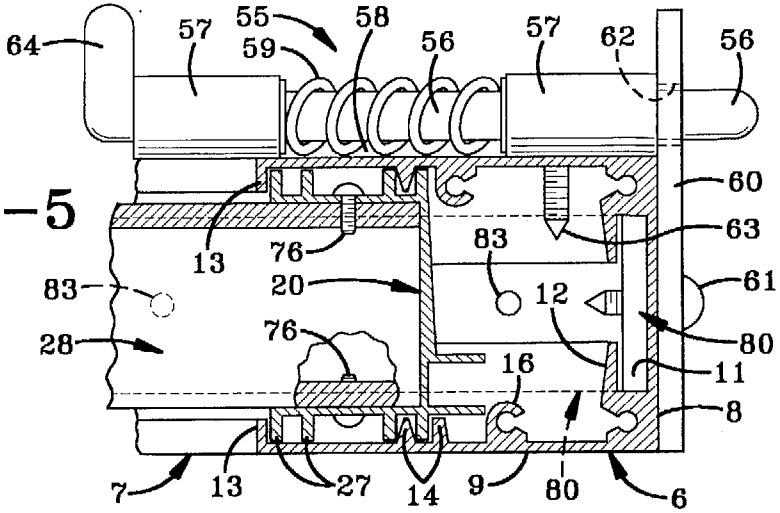
FIG. 5 is an enlarged fragmentary sectional view taken on line 5—5, FIG. 1.

Shutter 1 includes an outer frame indicated generally at 5, formed by a pair of similar, preferably identical, vertical parallel spaced U-shaped frame channels 6 and two similar, preferably identical, U-shaped top and bottom frame channels 7. One of the side frame channels 6 is shown in cross section in FIG. 8 and includes an end wall 8 and a pair of spaced parallel side walls 9 which form the U-shaped cross-sectional configuration. A slide channel 11 is formed along the inside surface of end wall 8 by a pair of spaced parallel channel-forming flanges 12. A pair of inturned flanges 13 extend along the outer free ends of side walls 9, and a plurality of inner ribs 14 are formed integrally with side walls 9 and extend longitudinally therealong. A screw boss 16 is formed integrally on the inside surface of each side wall 9 and extends longitudinally therealong and is spaced inwardly from ribs 14. The purpose of these ribs and channel flanges is discussed further below. The cross-sectional configuration of top and bottom frame channels 7 are similar to that described above with respect to vertical frame channels 6 and are best shown in FIGS. 2 and 5, and, therefore, are not discussed in further detail. Side channels 6 and top and bottom frame channels 7 preferably are extruded of aluminum and have a wall thickness of approximately 0.050 inches in the preferred embodiment.

Figure 9:
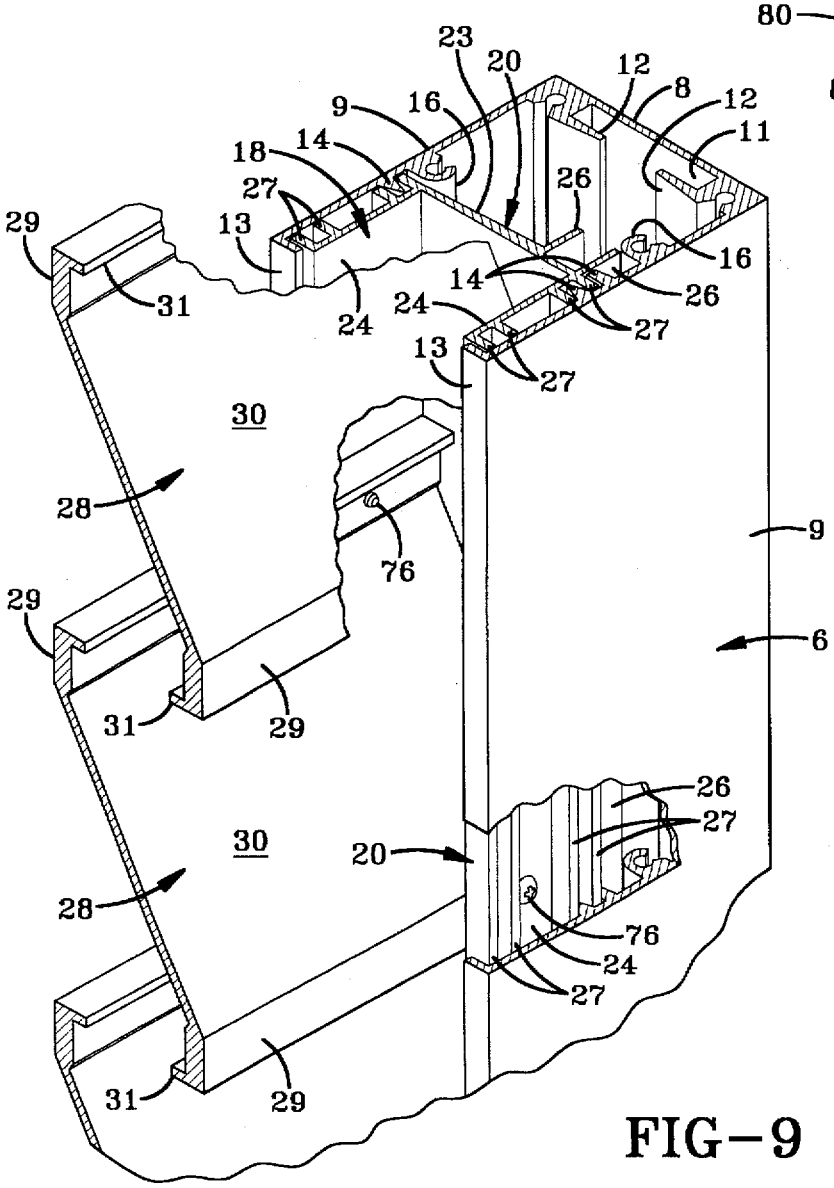
FIG. 9 is an enlarged fragmentary sectional view of a plurality of the louver blades mounted within one of the vertical blade channels and vertical frame channels.

In accordance with another of the features of the invention, an inner rectangular frame, indicated generally at 18, is mounted and retained within outer frame 5. Inner frame 18 is formed of two similar, preferably identical, side blade channels, each of which is indicated generally at 20 (FIG. 7), and two similar, preferably identical, horizontal blade channels, indicated generally at 21. Top horizontal blade channel 21 is best shown in FIG. 2, and the configuration of vertical side blade channels 20 is best shown in FIGS. 5, 7 and 9. The cross-sectional configuration of the inner blade channels is similar, and, therefore, only one is described in detail and shown in FIG. 7. The only difference between the channels is that the vertical blade channels 20 will, in most shutter constructions, be longer than horizontal blade channels 21. Referring to FIG. 7, blade channel 20 is an integral one-piece extruded aluminum member having a wall thickness of 0.040 inches in the preferred embodiment.

Channel 20 has an end wall 23 and a pair of parallel spaced side walls 24. A pair of spaced parallel blade-retaining flanges 26 are formed integrally with end wall 23 and extend outwardly therefrom, and provide strength to end wall 23. Flanges 26 are used in top and bottom horizontal blade channels 21 to secure a louver blade, indicated generally at 28 (FIG. 2), therebetween, as described in greater detail below. Referring again to FIG. 7, two pairs of spaced flanges or fins 27 are formed integrally with side walls 24 and extend outwardly therefrom, with the two fin pairs 27 closest to end wall 23 forming a slide channel for receiving one of the 14 of the outer frame channels therein.

A plurality of louver blades 28 are mounted in a vertical spaced relationship with respect to each other, as shown in FIGS. 1, 2 and 9, and extend horizontally across the shutter between vertical side blade channels 20. In accordance with one of the main features of the invention, each louver blade 28 has a generally Z-shaped cross-sectional configuration, with a pair of spaced parallel end flanges 29 and an intervening angularly extending flat panel 30. A lip 31 extends along and outwardly from each end flange 29 to increase the rigidity of the louver blades and to form an interlocking member, as described further below. As best shown in FIG. 9, panel 30 is of a thinner material than that of end flanges 29, preferably having a thickness of approximately one-half the thickness of the end flanges. This provides a louver blade which, when experiencing large wind forces and impacts on the flat panel 30 thereof, will flex, thereby transmitting the forces to the thicker and stronger end flanges 29. In the preferred embodiment, panels 30 will have a thickness of 0.060 inches, and flanges 29 have a thickness of 0.125 inches, and will be an integral one-piece aluminum extrusion.

Shutter 1 further includes a hinge assembly, indicated generally at 35 (FIGS. 1 and 2), for pivotally mounting the shutter onto supporting structure 4. Hinge assembly 35 consists of two, preferably aluminum, extrusions consisting of a hinge header and a hinge frame, indicated generally at 36 and 37, respectively. Hinge header 36 includes a vertically extending leg 38 which is adapted to be mounted on a flat surface of support structure 4 generally above a window sill 39 by a plurality of fastening screws 40. A plurality of raised peaks 42 extend outwardly from the rear surface of leg 38 and mount against the supporting structure to assist in securing hinge header 36 thereon. An outwardly extending flange 41 extends along the top edge of vertical leg 38 and forms a caulk shelf for receiving a bead of sealing caulk 43 therein to retard the ingress of water behind leg 38.

Hinge header 36 further includes a generally horizontally extending leg 45 formed integrally with leg 38 which preferably is at a slight obtuse angle with respect to leg 38 to prevent the retention of water thereon. The outer free end of leg 45 is formed with a ball socket 46 and a downwardly bent end flange 47. Flange 47 functions as a stop for limiting the opening movement of shutter 1, as shown particularly in FIG. 2. A U-shaped channel 49 is formed on the underside surface of leg 45 generally adjacent leg 38 to form an interlock with an end flange 50 extending outwardly from an end of hinge frame 37. Two screw bosses 44 are formed on leg 45 for securing end caps 48 thereto.

Hinge frame 37, in addition to end flange 50, includes a pair of spaced parallel flanges 51 and 52 which form a U-shaped intervening channel for receiving therein the top U-shaped frame channel 7, as shown in FIG. 2. A generally ball-shaped member 54 is formed on one end of hinge frame 37 adjacent end flange 52, and is slip fitted into ball socket 46 to rotatably mount hinge frame 37 on hinge header 36 and to mount the shutter on structure 4.

Figure 3:
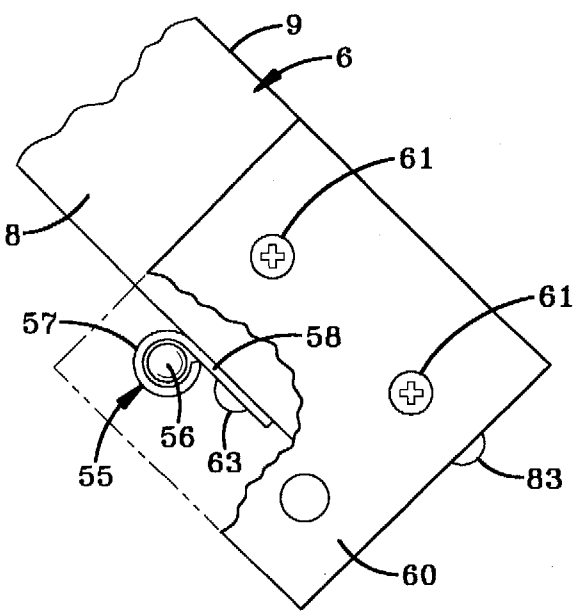
FIG. 3 is an enlarged fragmentary end elevational view, with portions broken away, looking in the direction of arrows 3—3, FIG. 1.

In accordance with another feature of the invention, a locking device, indicated generally at 55, is mounted on both lower corners of outer frame 5 for securing shutter 1 in a closed locked position. Each locking device 55 is similar, and, therefore, only one is described in detail and shown particularly in FIGS. 3, 4 and 5. Each locking device includes a spring-biased latching rod 56 which is slidably mounted between a pair of circular ears 57 formed as a part of a U-shaped mounting bracket 58. Bracket 58 is secured by fasteners 63 to bottom frame channel 7. A coil spring 59 is mounted between ears 57 and biases rod 56 to an outward locking position, as shown particularly in FIGS. 4 and 5. The inner end 64 of rod 56 is inturned to provide a gripping area or finger tab for moving rod 56 inwardly and overcoming the biasing force of spring 59 to unlock device 55. A reinforcing rod guide plate 60 is mounted by a pair of fasteners 61 onto the end wall 8 of each vertical side frame channel 6. Rod 56 will move through a hole 62 formed in plate 60 when moving to a locked position.

An L-shaped bracket 65 has its leg 66 secured by a plurality of fasteners 67 to supporting structure 4 adjacent a window sill or lower window frame member 68. A second leg 70 of bracket 65 is formed with an opening 71 through which the end of rod 56 extends when locking device 55 is in the locked position of FIG. 4.

Figure 4:
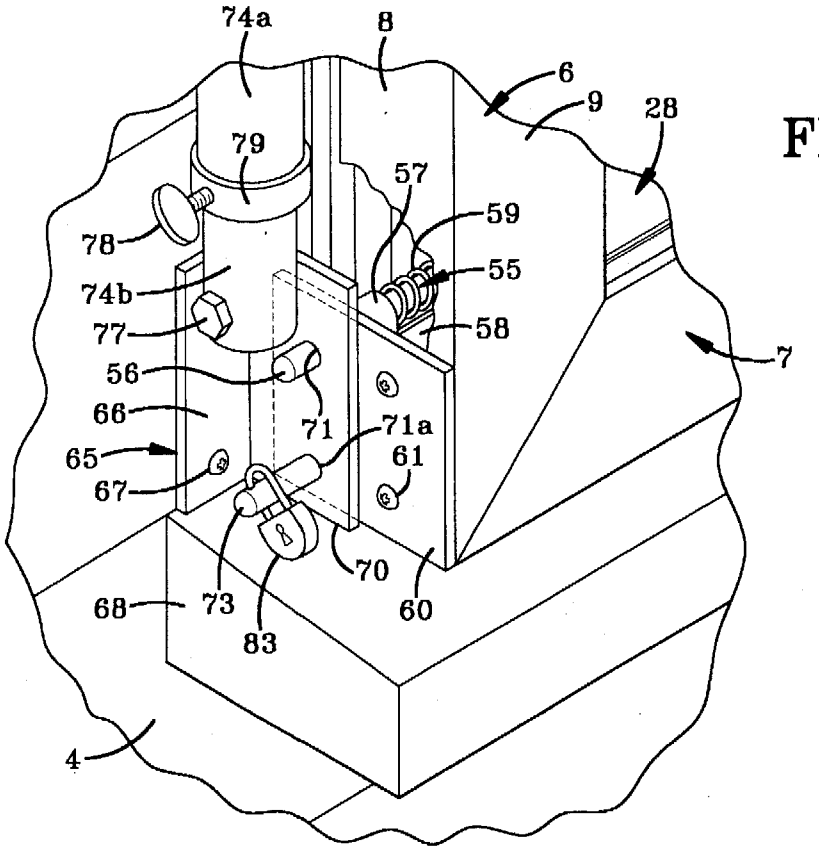
FIG. 4 is an enlarged fragmentary perspective view with portions broken away, showing one of the locking devices securing the shutter in a closed position.

Also shown in FIG. 4 is one end of a security bar 73 which may be used with shutter 1, if desired. Bar 73 would extend along the bottom of the shutter between the frame and window casing and extend through a hole 71*a* formed in bracket 65 at each end of the shutter. One end of the bar (not shown) could have an upturned end, with the other end receiving a lock 83 to lock the bar in its installed position.

A pair of telescoping support arms 74*a* and 74*b* (FIGS. 1 and 4), preferably formed of tubular material, is pivotally connected by a bolt 75 to end wall 8 of vertical side frame channel 6, and is pivotally connected at its opposite end by a bolt 77 to leg 70 of L-shaped bracket 65. A thumbscrew 78 and a lock ring 79 lock the two support arms 74*a* and 74*b* in the closed position, as shown in FIG. 4, or in an extended position, as shown in FIG. 1.

Figure 10:
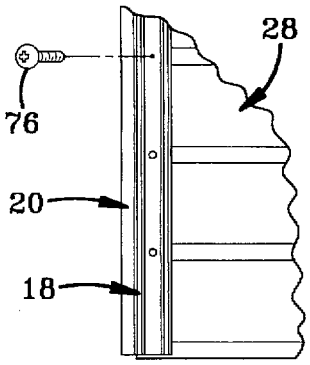
FIG. 10 is a fragmentary diagrammatic view showing the initial step of assembling the shutter.

The method of assembly of shutter 1 is diagrammatically illustrated partially in FIGS. 10–12, and is described below together with a discussion of the various features and advantages achieved by the shutter and its various components discussed above.

In the assembly of shutter 1, a plurality of louver blades 28 are arranged horizontally between a pair of vertical side blade channels 20 and are secured in the manner shown particularly in FIG. 9 by fasteners 76, such as Phillips sheet metal screws, which extend through channel side wall 24 and into one of the end flanges 29 of each louver blade. As shown in FIG. 9, one flange 29 is secured to the frontmost side wall 24 of vertical blade channel 20, with the other flange 29 being secured by a fastener 76 to the opposite side wall 24 of blade channel 20, with panel 30 extending generally angularly between spaced side walls 24. As shown in FIG. 2, the lowermost end flange 29 of each louver blade 28 is generally aligned with the topmost end flange 29 of the adjacent louver 28. This enables flange lips 31 to engage with each other, as shown in dot-dash lines, should one of lower fasteners 76 become disengaged from its flange 29 during extremely high winds and impact forces, preventing damage to the window or structure protected by the shutter.

Figure 11:
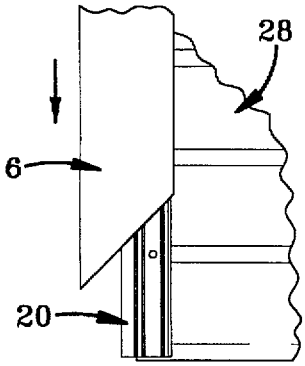
FIG. 11 is a fragmentary diagrammatic view similar to FIG. 10 showing the next step of the shutter assembly.

After the two vertical blade channels 20 are assembled with the required number of louver blades 28 to form a louver assembly, a pair of vertical side frame channels 6 are slidably mounted along the ends of the louver assembly in a sliding engagement, as is illustrated in FIGS. 9 and 11. The top and bottom channels are notched and fit beyond the frame intersection (FIG. 6) extending into the side frame channel and locking into place. This provides for a friction fit and eliminates tendency of the miter joint to twist.

Figure 6:
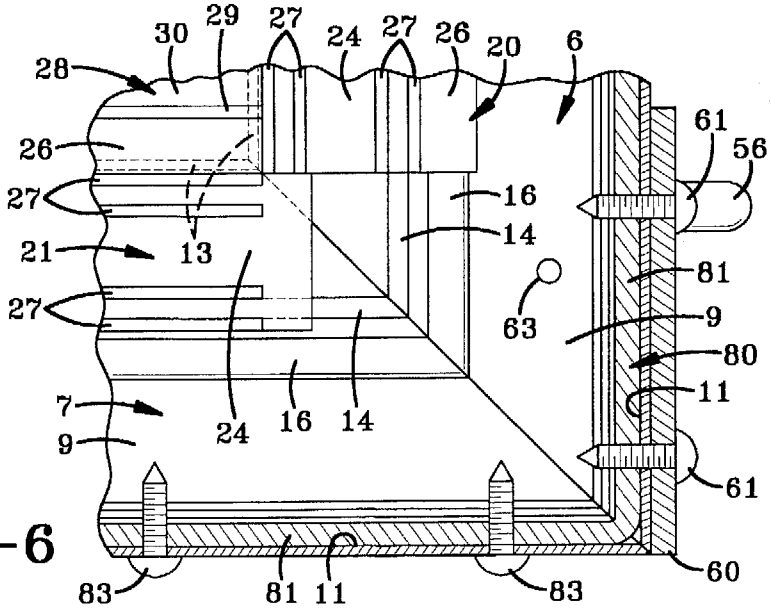
FIG. 6 is an enlarged fragmentary sectional view of the encircled portion of FIG. 1.
Figure 12:
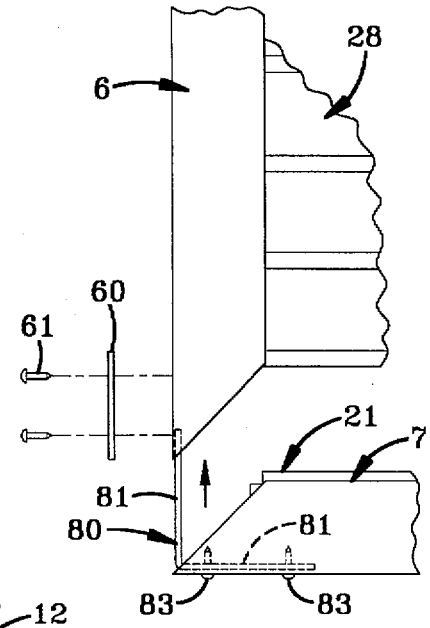
FIG. 12 is a fragmentary view similar to FIGS. 10 and 11 showing the further assembly of the shutter construction.

Next, a horizontal blade channel 21 is slidably mounted within a top and bottom U-shaped frame channel 7 to form subassemblies, one of which is shown in FIG. 12. This is followed by the joinder of top and bottom of frame channels 7 with vertical side frame channel 6 by four corner L-shaped braces 80. Each leg 81 of brace 80 is slip fitted into a respective slide channel 11 of frame channels 6 and 7, as shown in FIGS. 2, 5 and 6, where they are secured by pairs of fasteners 83 for each bracket leg. Only one corner and brace is shown in FIG. 12, with an enlargement thereof being shown in FIG. 6. It is readily understood that a corner brace 80 will be mounted at each corner to secure frame channels 6 and 7 into the rigid outer frame 5, which in turn traps inner frame 18 therein. Fastening screws 61 of guide plates 60 will also secure one leg 81 of each lower corner brace 80 to its respective outer frame channel side wall, avoiding additional fasteners being required.

After assembly of shutter 1 in the manner discussed above, hinge frame 37 is secured by a plurality of fasteners 84 to the end wall of top frame channel 7, as well as by the corner brace fasteners 82.

Set forth below is a brief discussion of the various features and advantages achieved by the particular components and their assembly described above and shown in the drawings.

Hinge header 36 of hinge assembly 35, and in particular, the raised peaks 42 thereof, will even out irregular surfaces on support structure 4 and control sealant displacement behind the various fastening points provided by fasteners 40. The integral caulk shelf at the leading edge 41 provides for a secure placement of caulk bead 43 thereon. The sloped, generally horizontal surface of leg 45 controls water flow. Likewise, channel 49 and end flange 50 provide an interlock of the header to the hinge frame when the shutter is in closed position, which ensures retention of the frame in the event of a main hinge ball socket failure, thus providing mechanical redundancy.

The formation of internal screw bosses 44 on hinge header 36 allows installation of end caps 85 (FIG. 1) which assist in containing lateral movement of the hinge assembly. Furthermore, as shown in FIG. 2, sufficient clearance is provided behind the back of the louver assembly due to the outward extension of hinge header 36, which allows for window molding. Also, the friction fit of top frame channel 7 within the U-shaped channel of hinge frame 37 facilitates the installation of screws or fasteners 84 through the hinge frame and into corner braces 80. Furthermore, the U-shape of hinge frame 37 provided by end flanges 51 will contain top frame channel 7 therein in the event of fastener failure, providing additional mechanical redundancy. Further, interlock channel 49 and end flange 50 assure proper alignment of the hinge at closure of the shutter.

L-shaped corner braces 80 are preferably formed of aluminum, as are the majority of the shutter components, and transfer forces exerted on the shutter around corners in lieu of fasteners or welding typical to other shutter structures. Furthermore, both hinge and hold-down loads are transferred through the braces which also enable a snap-together assembly of the outer frame channels and requires fasteners only to add strength in larger shutters or extreme environments.

Locking bolt guide plate 60, also referred to as a hold-down tab, enables hold-down loads and forces to be transferred to the wall-attached L-shaped bracket 65, which bracket also provides the attachment of the bottom end of each support arm 74 at one location, minimizing the number of fasteners and corresponding wall penetration required in the supporting structure. The attachment of support arm 74 to bracket 65 eliminates the need to disconnect the support arm from the bracket to lock down the shutter, as in many shutter constructions, since the same is achieved easily by loosening thumbscrew 78 of lock ring 79, whereby lower tube section **74*b* slides easily within upper tube section 74*a*. The captive arrangement of locking rod 56 within rolled ears 57 of U-shaped bracket 58** prevents loss and removal of the locking rod during use in storage of the shutter.

The unique shape of the four frame channels 6 and 7, which are extruded easily of aluminum and cut into the proper lengths, allows press fitting of L-shaped corner brackets 80 therein which supplies rigidity to the corners in lieu of fasteners or welding, as required in other shutter constructions. The screw bosses 16 can allow fasteners to be installed as required to increase strength of the frame channel mitered corners. Also, blade channels 20 and 21 press fit into the frame channels concealing all blade fasteners 76. Furthermore, the cross-sectional configuration of the frame channels slidably mount the blade channels therein, and provides mechanical redundancy should the blade channel fail under impact, releasing blades into the body of the outer channel where they are held captive. The interlocking of the frame channels to the blade channels is self-aligning and unidirectional in retention.

The unique cross-sectional configuration of the extruded aluminum blade channels 20 and 21 accept the blade fasteners on the vertical sides of the side channels and inverts to capture the blade itself on the top and bottom horizontal blade channels 21. The press fit of the blade channels into the frame channels transmits impact forces through aluminum pressure points and not fasteners. Most importantly, fins 27 on the outside surfaces of the blade channels radiate impact energy into the frame channels and flex to absorb and dispose of the force rather than break. The blade channels are designed to capture and maintain control of louver blades 28 even if the blades break free of the fasteners, providing additional mechanical redundancy.

Blades 28 are designed to interlock with each other upon fastener failure through lips 31, as shown in dot-dash lines in FIG. 2, increasing impact resistance beyond ability of the fasteners. Furthermore, the design of the louver blades allows maximum visibility when open and total perpendicular coverage when the shutter is closed. The flat planar blade panel 30 is thinner than end flanges 29 and will flex upon impact, transferring load to the heavier, thicker extruded end flanges. This partially transforms perpendicular impact forces into a parallel pulling force. This splitting of the force reduces point forces needed to be counteracted by a sharing effect. Blades 28 will remain captive and restrained, even upon total fastener failure at their end edges due to the design of the blade and frame channels.

The improved shutter is designed to withstand debris impact caused by hurricane wind forces, as well as withstanding the wind itself, thereby protecting the windows and maintaining an intact outer envelope. Both the wind and impact forces are transferred through the shutter, which will allow for fastener failure in the blade and hinge attachment, without loss of protection, through the mechanical redundancy of the shutter, as described above. When fasteners fail, the interlocking extrusions ensure that the pieces remain captive and functional.

Also, when a hurricane or other inclement weather threatens, the shutter is easily lowered into its protective position without the use of tools from the inside of the structure. Further, afterwards, the shutter can be easily returned to its open position where its sun-shading ability and decorative functions remain. Also, the support arms and their pivot fasteners need not be removed at any time. All of the fasteners, parts and components of the improved shutter stay captive and require no tools or disassembly for implementation of the shutter.

In accordance with one of the main features of the invention, the impact forces travel through the fasteners and are dissipated into the outer frame and then dissipated into the structure. The mechanical redundancy provided by the interlocking blades and frame hinge extrusions, along with the sacrificial inner fins, allow for relatively light extrusions and fasteners to be utilized. Even should severe impacts cause fastener failure and extrusion distortion, it will be controlled by the interlocking design of the various extruded frame members.

The shutter is permanently installed on the structure and, as indicated above, is lowered in position when the weather threatens and is easily opened after the storm. The hinge allows for a 41° shutter open angle, which angle corresponds closely to the 39° blade inclination. This results in a relatively unobstructed view from the inside of the structure to the outside, and vision into the louvered window is hindered by the angle of incidence and provides privacy and security. The angle of mounting when opened, along with the blade, provides shading of the window, reducing heat gain considerably. This shading eliminates the need for window films and the like to reduce heat penetration, as is required with other shutter constructions. Furthermore, the L-shaped corner brackets are held in place by friction and by several of the fastener screws.

Accordingly, the improved shutter construction and method is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved shutter construction is constructed and used, the characteristics of the construction, and the advantageous, new and useful results obtained; the new and useful structures, devices, elements, arrangements, parts and combinations, and method steps are set forth in the appended claims.

We claim:

1. A shutter construction including:

an outer rectangular frame defined by horizontal and vertical frame channels, said frame channels being similar to each other, each being U-shaped in cross section defined by an end wall and spaced parallel side walls, and corner braces securing together adjacent ends of said frame channels to form said outer rectangular frame;

an inner rectangular frame defined by horizontal and vertical blade channels, each having side walls, with said inner frame being mounted and contained within the outer frame;

a plurality of blades mounted within the inner frame and extending horizontally between the vertical blade channels, said blades being generally Z-shaped in cross section having a pair of end flanges and a panel extending angularly therebetween, said panel being thinner than said end flanges, whereby said panels will flex upon impact forces being exerted thereon transferring said forces to the said end flanges; and a plurality of fins formed on the side walls of the vertical blade channels and extending toward adjacent vertical side walls of the outer frame channels to radiate impact forces exerted on the blades into the outer frame channels.

2. The shutter construction defined in claim 1 in which a slide channel is formed on an inner surface of the end wall of each of the frame channels at least adjacent the ends thereof; and in which the corner braces are slidably mounted within said slide channels to secure together the adjacent ends of said frame channels.

3. The shutter construction defined in claim 2 in which the corner braces are L-shaped; and in which fasteners secure the L-shaped corner braces to the end walls of the frame channels.

4. The shutter construction defined in claim 1 in which the blade panels are approximately one-half the thickness of the blade end flanges.

5. The shutter construction defined in claim 1 including a hinge assembly for movably mounting the shutter on a structure adjacent an opening found in said structure.

6. The shutter construction defined in claim 5 in which the hinge assembly includes a first member adapted to be secured to the structure and a second member secured to one of the horizontal frame channels of the outer frame and hingedly connected to said first member.

7. The shutter construction defined in claim 6 in which the first member of the hinge assembly includes a ball socket; and in which the second member includes a ball mounted within the ball socket of said first member for hingedly connecting said second member to said first member.

8. The shutter construction defined in claim 7 in which the first member is generally L-shaped having a vertical leg adapted to be secured to the structure and a slightly inclined horizontal leg; and in which the ball socket is formed on a free end of the horizontal leg.

9. The shutter construction defined in claim 8 in which a top edge of the vertical leg of the first member is inclined outwardly and forms a caulk shelf with the structure when secured thereto for receiving a bead of a sealing caulk thereon.

10. The shutter construction defined in claim 8 in which an interlock channel is formed on an underside surface of the horizontal leg of the hinge assembly first member and receives therein a locking flange formed on the second member of the hinge assembly when the shutter is in a closed position on the structure.

11. The shutter construction defined in claim 8 in which a stop flange extends outwardly beyond the ball socket of the horizontal leg of the L-shaped first member and is engageable with the outer frame to limit the movement of the shutter in an open position.

12. The shutter construction defined in claim 6 in which the second member of the hinge assembly includes a U-shaped channel; and in which a topmost horizontal frame channel of the outer frame is secured within said U-shaped channel of said second member.

13. The shutter construction defined in claim 1 including lock means mounted on the outer frame for locking the shutter in a closed position on a structure.

14. The shutter construction defined in claim 13 in which the lock means includes at least one spring-biased plunger movably mounted on a lowermost one of the horizontal frame channels.

15. The shutter construction defined in claim 1 in which a pair of adjustable support arms are pivotally mounted on one end thereof on the vertical frame channels and are attached at opposite ends to brackets adapted to be secured to a support structure on which the shutter is mounted.

16. The shutter construction defined in claim 15 in which a lock device is mounted on the outer frame and includes a locking rod; and in which said locking rod operatively engages one of the support arm brackets to secure the shutter in a closed position.

17. The shutter construction defined in claim 16 in which the support arm bracket is L-shaped and has a pair of legs; in which a hole is formed in one of the bracket legs and receives the locking rod therein; and in which the said opposite end of one of the support arms is pivotally secured to the other leg of said L-shaped bracket.

18. A shutter construction including:

an outer rectangular frame defined by horizontal and vertical frame channels, said frame channels being similar to each other, each being U-shaped in cross section defined by an end wall and spaced parallel side walls, and corner braces securing together adjacent ends of said frame channels to form said outer rectangular frame;

an inner rectangular frame defined by similar horizontal and vertical blade channels each being substantially U-shaped in cross section defined by an end wall and spaced parallel inner and outer side walls with said inner frame being mounted and contained within the outer frame;

a plurality of blades mounted within the inner frame and extending horizontally between the vertical blade channels, said blades being generally Z-shaped in cross section having a pair of end flanges and a panel extending angularly therebetween, said panel being thinner than said end flanges, whereby said panels will flex upon impact forces being exerted thereon transferring said forces to the said end flanges; and fastener means for securing the end flanges of the blades to the side walls of the vertical blade channels with the panels extending angularly between the spaced side walls of said vertical blade channels.

19. The shutter construction defined in claim 18 in which a plurality of fins are formed on the side walls of certain of the blade channels and extend toward adjacent side walls of certain of the outer frame channels to radiate impact forces exerted on the blades into the outer frame channels.

20. The shutter construction defined in claim 19 in which projections are formed on the side walls of certain of the outer frame channels and are received between certain of the fins of the blade channels to mount the inner frame within the outer frame.

21. A shutter construction including:

an outer rectangular frame defined by horizontal and vertical frame channels, said frame channels being similar to each other, each being U-shaped in cross section defined by an end wall and spaced parallel side walls, and corner braces securing together adjacent ends of said frame channels to form said outer rectangular frame;

an inner rectangular frame defined by horizontal and vertical blade channels, said inner frame being mounted and contained within the outer frame;

a plurality of blades mounted within the inner frame and extending horizontally between the vertical blade channels, said blades being generally Z-shaped in cross section having a pair of end flanges and a panel extending angularly therebetween, said panel being thinner than said end flanges, whereby said panels will flex upon impact forces being exerted thereon transferring said forces to the said end flanges; and a hinge assembly for movably mounting the shutter on a structure adjacent an opening found in said structure, said hinge assembly including a first member adapted to be secured to the structure and a second member secured to one of the horizontal frame channels of the outer frame and hingedly connected to said first member, said first member including a ball socket and said second member including a ball mounted within the ball socket of said first member for hingedly connecting said second member to said first member.

22. The shutter construction defined in claim 21 including fastener means for securing the end flanges of the blades to the side walls of the vertical blade channels with the panels extending angularly between the spaced side walls of said vertical blade channels.

23. A shutter construction including:

an outer rectangular frame defined by horizontal and vertical frame channels, said frame channels being similar to each other, each being U-shaped in cross section defined by an end wall and spaced parallel side walls, and corner braces securing together adjacent ends of said frame channels to form said outer rectangular frame;

an inner rectangular frame defined by horizontal and vertical blade channels, said inner frame being mounted and contained within the outer frame;

a plurality of blades mounted within the inner frame and extending horizontally between the vertical blade channels, said blades being generally Z-shaped in cross section having a pair of end flanges and a panel extending angularly therebetween, said panel being thinner than said end flanges, whereby said panels will flex upon impact forces being exerted thereon transferring said forces to the said end flanges; and lock means mounted on the outer frame for locking the shutter in a closed position on a structure, said lock means including at least one spring-biased plunger movably mounted on a lowermost one of the horizontal frame channels.

24. A shutter construction including:

an outer rectangular frame defined by horizontal and vertical frame channels, said frame channels being similar to each other, each being U-shaped in cross section defined by an end wall and spaced parallel side walls, and corner braces securing together adjacent ends of said frame channels to form said outer rectangular frame;

an inner rectangular frame defined by horizontal and vertical blade channels, said inner frame being mounted and contained within the outer frame;

a plurality of blades mounted within the inner frame and extending horizontally between the vertical blade channels, said blades being generally Z-shaped in cross section having a pair of end flanges and a panel extending angularly therebetween, said panel being thinner than said end flanges, whereby said panels will flex upon impact forces being exerted thereon transferring said forces to the said end flanges;

a pair of adjustable support arms pivotally mounted at one end on the vertical frame channels and attached at opposite ends to brackets adapted to be secured to a support structure on which the shutter is mounted;

a lock device mounted on the outer frame having a locking rod for operatively engaging one of the support arm brackets to secure the shutter in a closed position, said support arm bracket being L-shaped and having a pair of legs; and a hole formed in one of the bracket legs and receiving the locking rod therein, with said opposite end of one of the support arms being pivotally secured to the other leg of said L-shaped bracket.

25. A shutter construction including:

an outer rectangular frame defined by horizontal and vertical frame channels, said frame channels being similar to each other, each being U-shaped in cross section and having an end wall and mitered ends, and corner braces securing together adjacent mitered ends of said frame channels to form said outer rectangular frame;

an inner rectangular frame defined by horizontal and vertical blade channels, said inner frame being mounted and contained within the outer frame;

a plurality of blades mounted within the inner frame and extending horizontally between the vertical blade channels;

a plurality of longitudinally extending fins formed on certain walls of either the vertical blade channels of the inner frame or certain walls of the vertical frame channels of the outer frame and extending between said certain walls of the vertical blade channels and vertical frame channels to radiate wind forces exerted on the blades into the outer frame; and a hinge assembly for movably mounting the shutter adjacent an opening of a structure, said hinge assembly including a first member adapted to be secured to a structure and a second member secured to the outer frame and hingedly connected to said first member, said first member including a ball socket and the second member including a ball mounted within the ball socket of said first member for hingedly connecting said second member to said first member.

26. The shutter construction defined in claim 25 in which said blades are generally Z-shaped in cross section each having a pair of end flanges and a panel extending angularly therebetween, said panel being thinner than said end flanges, whereby said panels will flex upon wind forces being exerted thereon transferring said forces to the thicker end flanges.

* * * * *